US006474905B1

(12) United States Patent
Smith, Jr. et al.

(10) Patent No.: US 6,474,905 B1
(45) Date of Patent: Nov. 5, 2002

(54) TEMPORARY SUPPORT STRUCTURE

(76) Inventors: Clarence R. Smith, Jr., 329 Smith La., Heidelberg, MS (US) 39439; Thomas O. Kelley, Jr., P.O. Box 1079, Waynesboro, MS (US) 39367; Jerry R. Kelley, P.O. Box 1079, Waynesboro, MS (US) 39367

( * ) Notice: Subject to any disclaimer, the term of this patent is extended or adjusted under 35 U.S.C. 154(b) by 0 days.

(21) Appl. No.: 09/924,008

(22) Filed: Aug. 7, 2001

(51) Int. Cl.[7] ..... E01C 9/08; E01C 5/14

(52) U.S. Cl. ..... 404/35; 404/36; 52/664; 108/53.1

(58) Field of Search ..... 404/34, 35, 36; 52/664, 591.1; 108/53.1, 53.3

(56) References Cited

U.S. PATENT DOCUMENTS

| | | | | | |
|---|---|---|---|---|---|
| 2,652,753 | A | * | 9/1953 | Smith | 404/35 |
| 2,819,026 | A | * | 1/1958 | Leyendecker | 404/35 |
| 2,912,909 | A | * | 11/1959 | Hart | 494/35 |
| 4,289,420 | A | * | 9/1981 | Davis et al. | 404/35 |
| 4,461,712 | A | * | 7/1984 | Penland, Sr. | 404/36 |
| 4,600,336 | A | * | 7/1986 | Waller, Jr. | 404/35 |
| 4,600,337 | A | | 7/1986 | Sarver | 404/35 |
| 4,875,800 | A | | 10/1989 | Hicks | 404/35 |
| 4,889,444 | A | | 12/1989 | Pouyer | 404/34 |
| 4,922,598 | A | | 5/1990 | Pouyer | 29/281.4 |
| 4,973,193 | A | | 11/1990 | Watson et al. | 404/35 |
| 5,020,937 | A | | 6/1991 | Pouyer | 404/35 |
| 5,032,037 | A | | 7/1991 | Phillips et al. | 404/73 |
| 5,087,149 | A | | 2/1992 | Waller, Jr. | 404/35 |
| 5,163,776 | A | | 11/1992 | Pouyer | 404/35 |
| 5,822,944 | A | * | 10/1998 | Penland, Sr. | 404/35 |

* cited by examiner

*Primary Examiner*—Thomas B. Will
*Assistant Examiner*—Alexandra K. Pechhold
(74) *Attorney, Agent, or Firm*—Walker, McKenzie & Walker PC

(57) ABSTRACT

A temporary support structure for use in soft and environmentally sensitive areas to construct roads and pads to support heavy equipment and the like on rough and normally impassable terrain. Roads and pads are constructed by interlocking a plurality of mats together to build a road or pad of the desired size. Each mat is comprised of two layers of boards made of a material with a shear stress equal to or greater than that of hardwood lumber. The top layer of boards are superimposed over the bottom layer and fastened by bolts, nails, glue, etc. Forklifts, cranes, etc., are used to handle individual mats and to position the mats and lock them together.

11 Claims, 10 Drawing Sheets

TEMPORARY SUPPORT STRUCTURE

BACKGROUND OF THE INVENTION

1. Field of the Invention

The present invention relates, in general, to temporary support structures used in soft and environmentally sensitive areas to construct roads and pads to support heavy equipment and the like.

2. Information Disclosure Statement

Wooden mats and roads have been utilized for many years particularly in the oil and gas industry to provide temporary roads and pads for construction equipment and heavy trucks in areas that are environmentally sensitive or inaccessible due to poor soil conditions during the rainy part of the year. These roads and mats are typically constructed one piece at a time and are very time consuming and labor intensive to construct.

As pressure on labor markets increased and time constraints on construction tightened, some mat systems appeared on the market, and worked well to relieve the labor and time problems. However, when the wooden mats are laid piece by piece, the number of plys of lumber were determined by the soil conditions and the size of the loads to be hauled across them. The mat systems commonly used today are three ply systems. As a general rule, fewer plies of lumber are required to accomplish the same result as elevation increases above sea level. For example, a mat having four plys of lumber may be necessary to support typical oil industry equipment over a wet site close to sea level, while a mat having only two plys of lumber may be adequate to support the same equipment over a dryer site located well above sea level, etc.

BRIEF SUMMARY OF THE INVENTION

The present invention provides a method and apparatus for temporary matting for use on constructions sites to satisfy the aforementioned needs.

The mat of the present invention includes, in general, a bottom ply having a first end edge, a second end edge, a first side edge, a second side edge, and at least a first opening therethrough; and a top ply having a first end edge, a second end edge, a first side edge, a second side edge, at least a first slot extending into the first end edge of the top ply, at least a first tab aligned with the first slot in the first end edge of the top ply to and extending out of the second end edge of the top ply, and at least a first opening therethrough; the top and bottom plies are attached to one another with the first opening of the top ply positioned over the first opening of said bottom ply, with said first end edges of the top and bottom plies substantially aligned with one another so that the first slot of the top ply extends over a portion of the bottom ply, and with the second end edges of said top and bottom plies substantially aligned with one another so that the first tab of said top ply extends outward of the bottom ply.

It is an object of the present invention to provide a temporary support structure comprising a two ply, interlocking mat system that minimizes costs and maximizes the use of labor, equipment and material to provide temporary access to construction sites regardless of weather and soil conditions.

It is another object of the present invention to provide such a temporary support structure comprised of a plurality of two ply mats of rectangular configuration that interlock with slots or tabs on all sides of the mat.

It is another object of the present invention to provide such a temporary support structure in which the upper and lower layer of each mat are perpendicular and all boards on each layer are uniformly spaced to minimize cracks and maximize strength of the mat.

It is another object of the present invention to provide such a temporary support structure in which the slots and tabs on each mat are uniformly spaced and of sufficient length so that, when two or more mats are properly butted or joined together, every slot and tab is overlapped by at least it's width.

It is another object of the present invention to provide such a temporary support structure which provides a very stable working area when the mats are locked together using the slots and tabs on the side of the mats, because the slots and tabs of the surrounding mats hold each mat in place.

It is another object of the present invention to provide such a temporary support structure in which a temporary road or pad can be constructed by lifting the mats with forklifts, cranes or other suitable equipment

DETAILED DESCRIPTION OF THE INVENTION

First Embodiment

Figure 1:
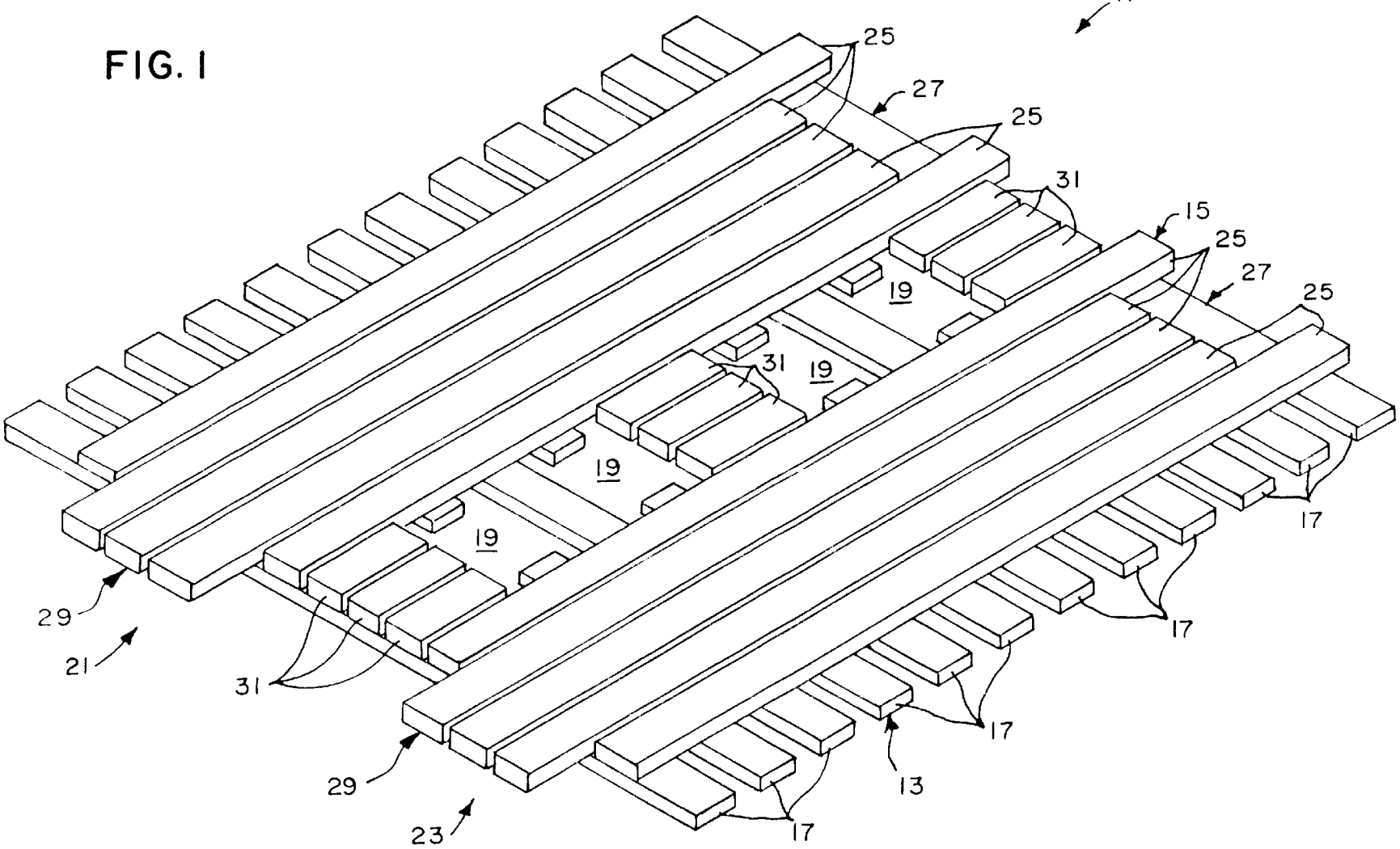
FIG. 1 is a perspective view of a first embodiment of the mat of the present invention.
Figure 2:
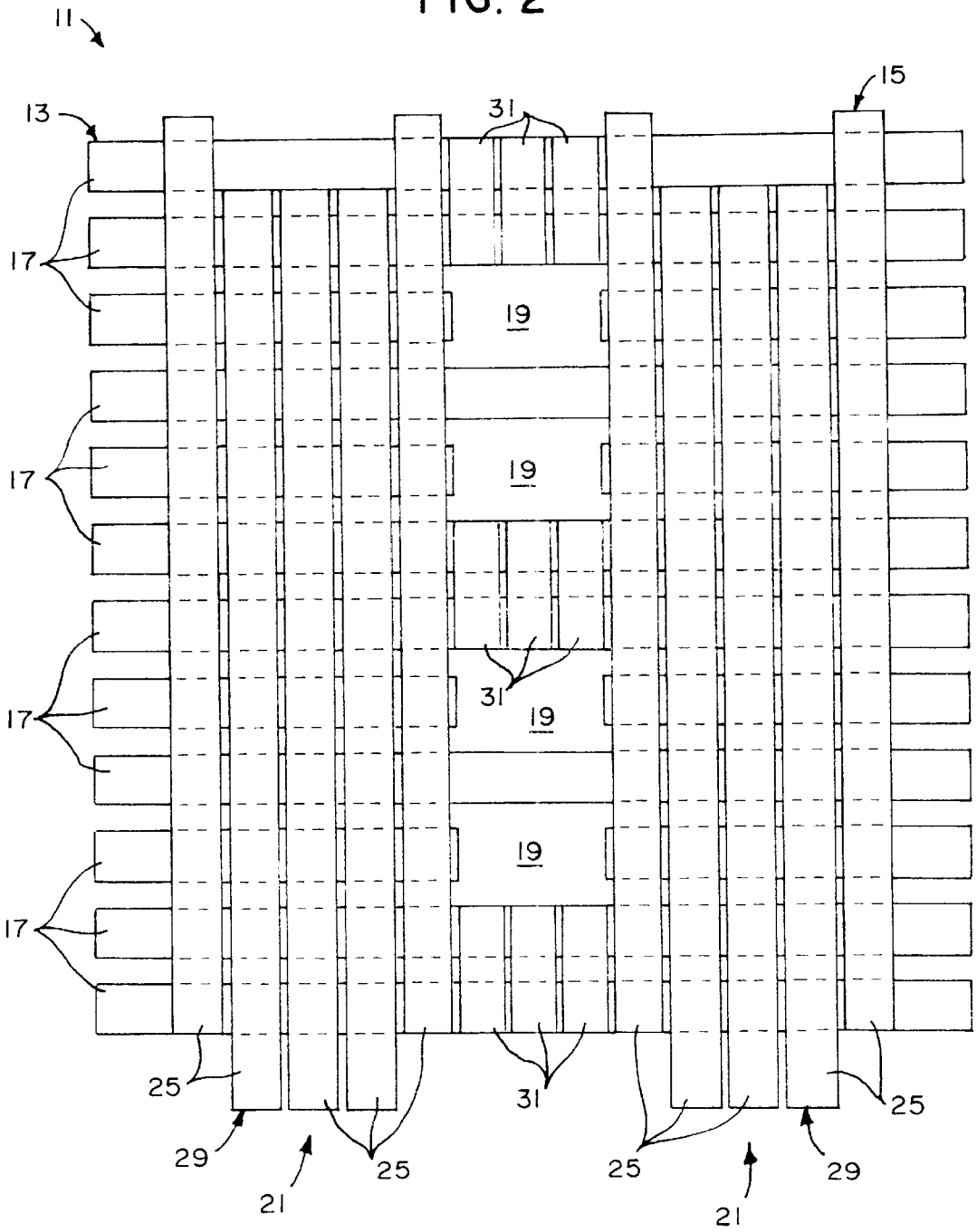
FIG. 2 is a top plan view of the mat of FIG. 1.
Figure 3:
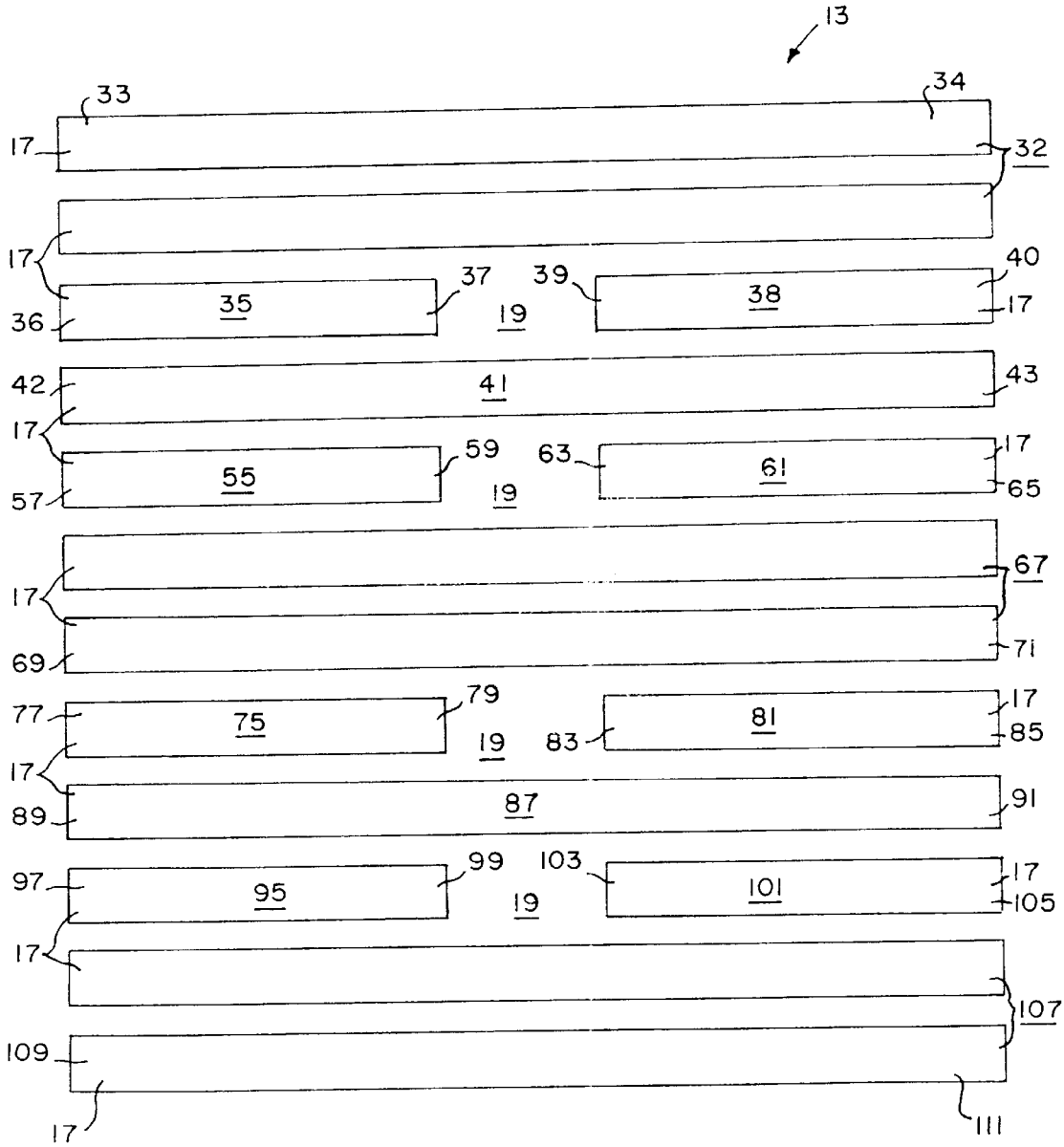
FIG. 3 is a top plan view of the bottom ply or layer of the mat of FIG. 1.
Figure 4:
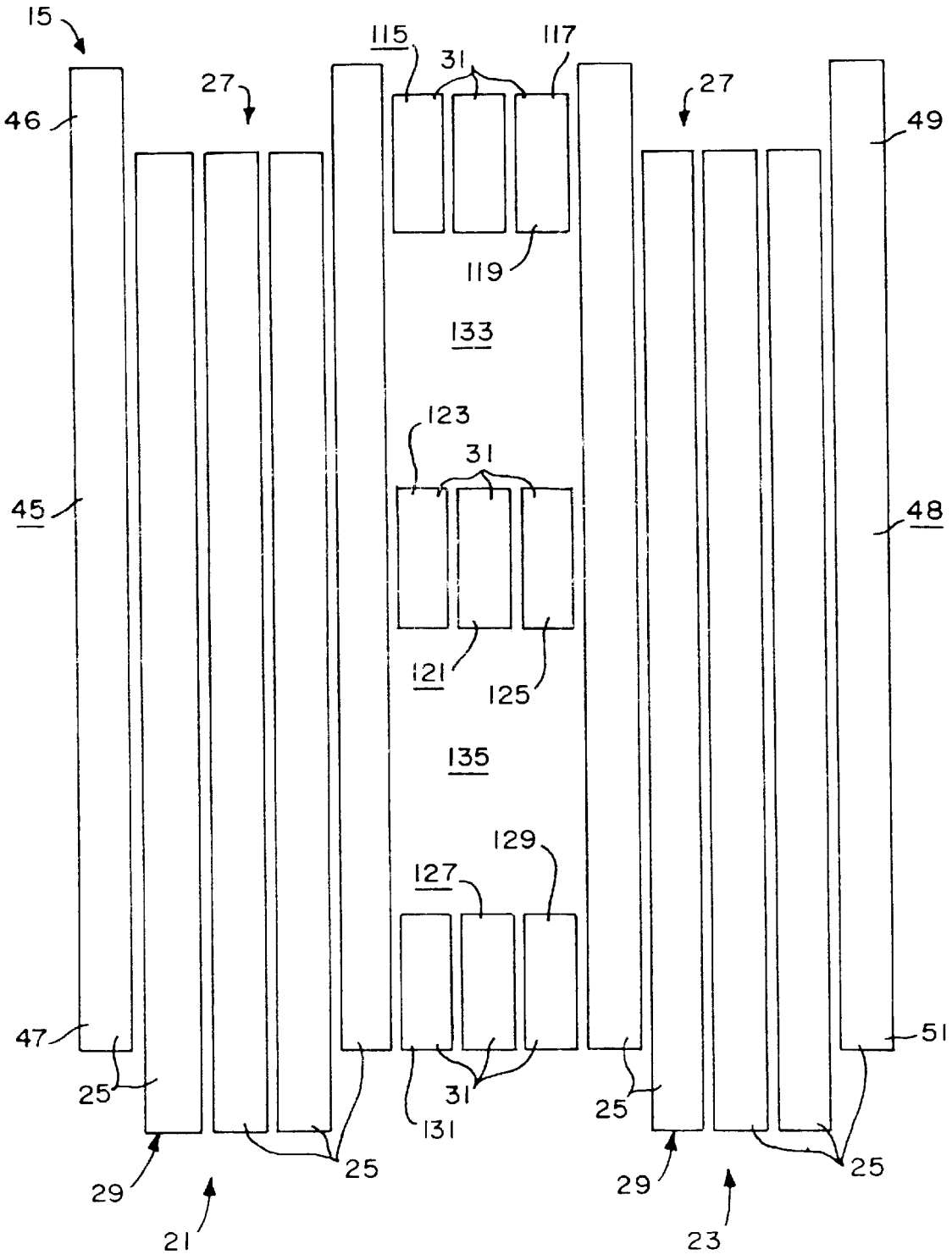
FIG. 4 is a top plan view of the top play or layer of the mat of FIG. 1.
Figure 5:
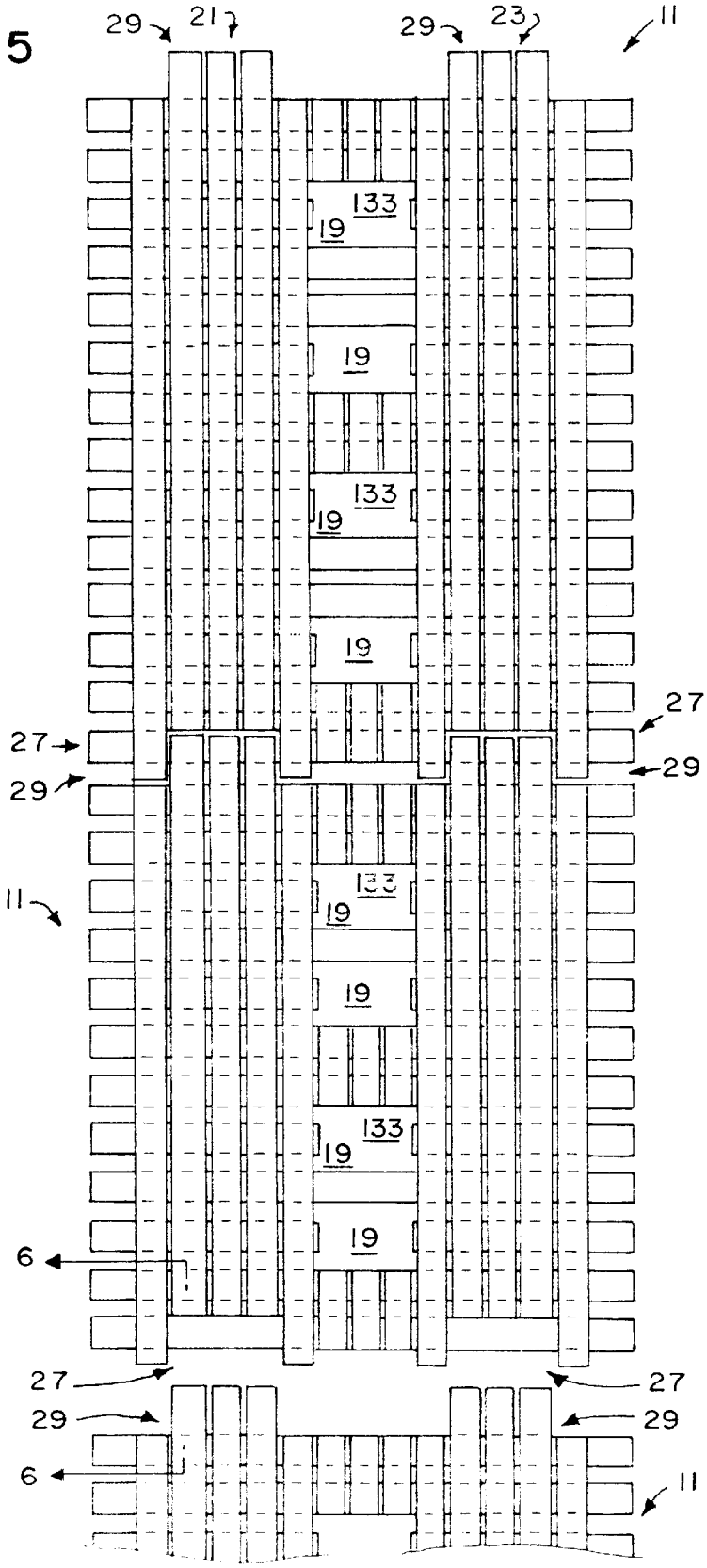
FIG. 5 is a diagrammatic top plan view of several of the mats of FIG. 1 joined and being joined to one another to construct a road, including mats of different lengths.
Figure 6:
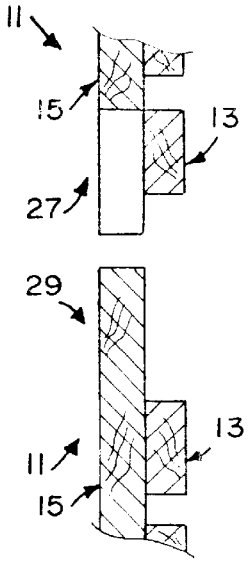
FIG. 6 is a sectional view substantially as taken on line 6—6 of FIG. 5, on a somewhat enlarged scale.

A first embodiment of the mat of the present invention is shown in FIGS. 1–6 and identified by the numeral 11. The mat 11 is designed for use in combination with a plurality of similar mats to provide a temporary support structure used to construct roads and pads to support heavy equipment. The mat 11 is especially designed for the construction of temporary roads to support heavy construction equipment and trucks typically used in the oil and gas industry and in logging, etc.

The mat 11 includes a bottom ply or layer 13 and a top ply or layer 15.

The bottom ply 13 may be constructed from a plurality of boards 17 of the same basic size. Thus, for a standard road, the bottom ply 13 is constructed from a plurality of 2 inches (5.08 centimeters) thick by 8 inches (20.32 centimeters) wide by 11.5 feet (3.5 meters) long lumber. Alternatively, the lumber could be 10 feet (3.05 meters) long. Each board 17 is arranged parallel and preferably spaced from one another an equal distance, e.g., 4 inches (10.16 centimeters). The number of boards 17 used to construct the bottom ply 13 can vary, depending on the length of mat 11 desired. Thus, for example, for a mat 11 that is 12 feet (3.7 meters) long, the bottom ply 13 preferably includes 12 boards 17. Similarly, for a mat 11 that is 14 feet (4.3 meters) long, the bottom ply 13 preferably includes 14 boards 17; and for mat 11 that is 16 feet (4.9 meters) long, the bottom play 13 preferably includes 16 boards 17.

While each of the boards 17 are preferably coextensive with one another, the middle portion of one or more of the boards 17 are preferably cut away to form a gap or opening 19 between the opposite ends of that board or boards 17. Thus, with respect to the 12 foot mat 13 shown in the drawings, the middle portion of the third and fifth boards 17 from each end is cut away to form the gaps or openings 19.

The top ply 15 may include a first track or runner 21 and a second track or runner 23. The runners 21, 23 support the wheels, etc., of heavy construction equipment and trucks typically used in the oil and gas industry and in logging, etc. In the preferred embodiment, each runner 21, 23 of the top ply 15 is constructed from a plurality of boards 25 of the same basic size. Thus, for a standard road, each runner 21, 23 is constructed from a plurality of 2 inches (5.08 centimeters) thick by 8 inches (20.32 centimeters) wide lumber. The length of each board 25 depends on the desired sized of the mat 11. Thus, for a mat 11 that is 12 feet (3.7 meters) long, each board 25 is preferably 12 feet (3.7 meters) long. Similarly, for a mat 11 that is 14 feet (4.3 meters) long, each board 25 is preferably 14 feet (4.3 meters) long; and for mat 11 that is 16 feet (4.9 meters) long, each board 25 is preferably 16 feet (4.9 meters) long. Each board 25 is arranged parallel and preferably spaced from one another an equal distance, e.g., 1 inches (2.54 centimeters). While the number of boards 25 used to construct each runner 21, 23 can vary, for a typical road each runner 21, 23 preferably includes five boards 25.

While each of the boards 25 are preferably the same length, the middle board or boards 25 of each runner 21, 23 are offset with respect to the outside boards 25 of each runner 21, 23 so that a slot 27 is formed at one end of each runner 21, 23 and a tab 29 is formed at the other end of each runner 21, 23. With respect to the mat 11 shown in the drawings, the middle three boards 25 of each five board runner 21, 23 is so offset.

The boards 25 of the top ply 15 are securely attached to the boards 17 of the bottom ply 13, using bolts, nails, glue, etc., with the longitudinal axis of each board 25 substantially perpendicular to the longitudinal axis of each board 17, and with the runners 21, 23 substantially parallel to one another and centered between the opposite ends of each board 17 with a space therebetween to locate the centerline of each runner 21, 23 the appropriate distance to support the wheels of heavy construction equipment and trucks typically used in the oil and gas industry and in logging, etc. Thus, the runners 21, 23 are preferably spaced apart approximately 26 inches (66.04 centimeters).

In addition to the runners 21, 23, the top ply 15 preferably includes a plurality of reinforcing boards 31 attached to a plurality of the boards 17 of the bottom ply 13 in the space between the runners 21, 23. Thus, the top ply 15 may include three reinforcing boards 31 attached to the first two, last two and middle two boards 17 of the bottom ply 13 for strengthening the first two, last two and middle two boards 17 of the bottom ply 13. The reinforcing boards 31 are preferably constructed from 2 inches (5.08 centimeters) thick by 8 inches (20.32 centimeters) wide by 20 inches (50.8 centimeters) long lumber, spaced apart from one another approximately 0.5 inches (1.27 centimeters). A set of reinforcing boards 31 are thus located adjacent each gap 19, and coact with the gaps 19 and the portion of the boards 17 covered by the reinforcing boards 31 to form means for allowing the mat 11 to be easily grabbed with grapple of a knuckleboom, a crane, a forklift truck, etc., for pick up, moving, laying, etc. The reinforcing boards 31 strengthen the associated boards 17 to prevent damage to the mat 11 when those boards 17 are clamped by a grapple, etc.

Second Embodiment

Figure 7:
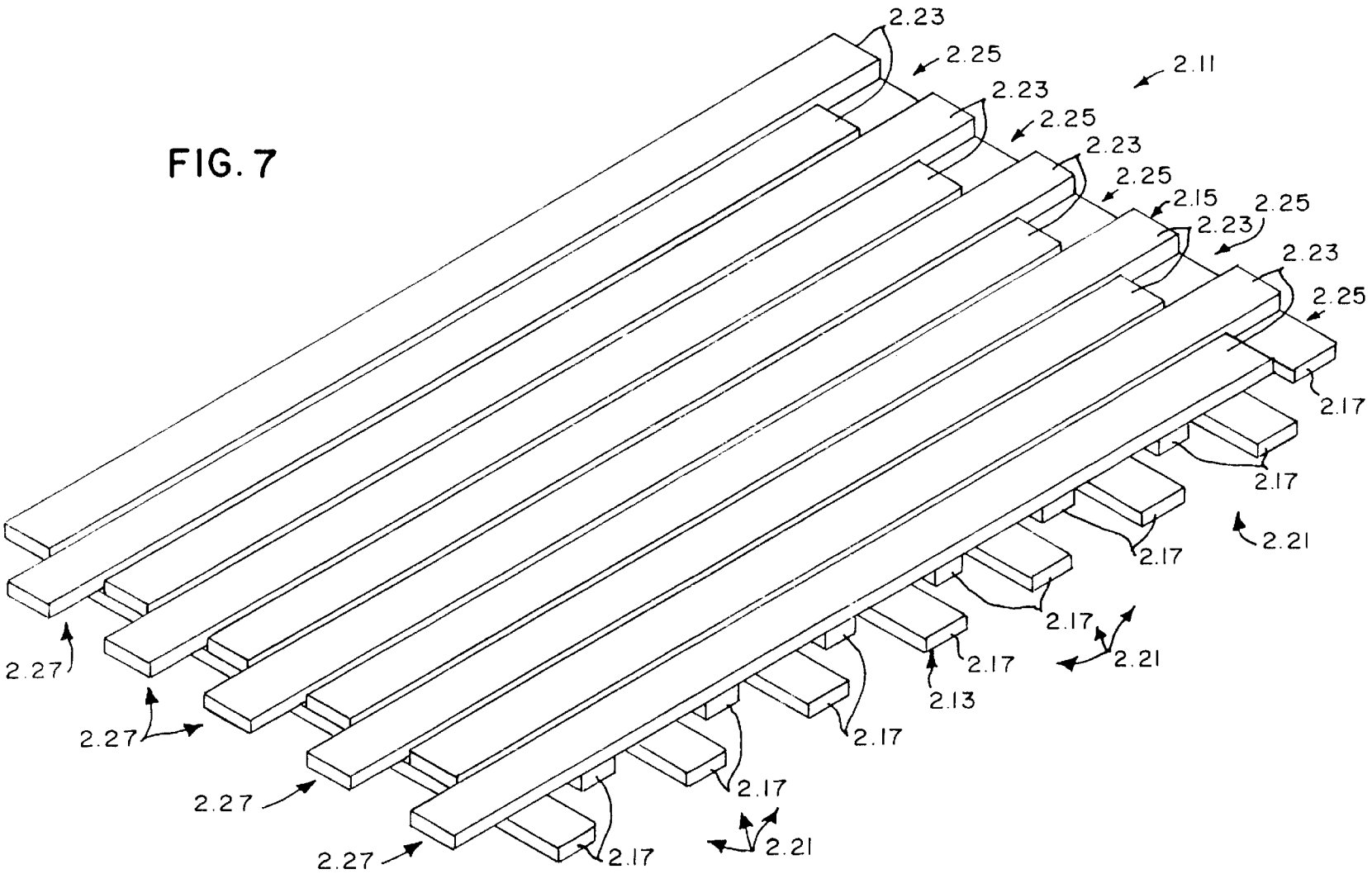
FIG. 7 is a perspective view of a second embodiment of the mat of the present invention.
Figure 8:
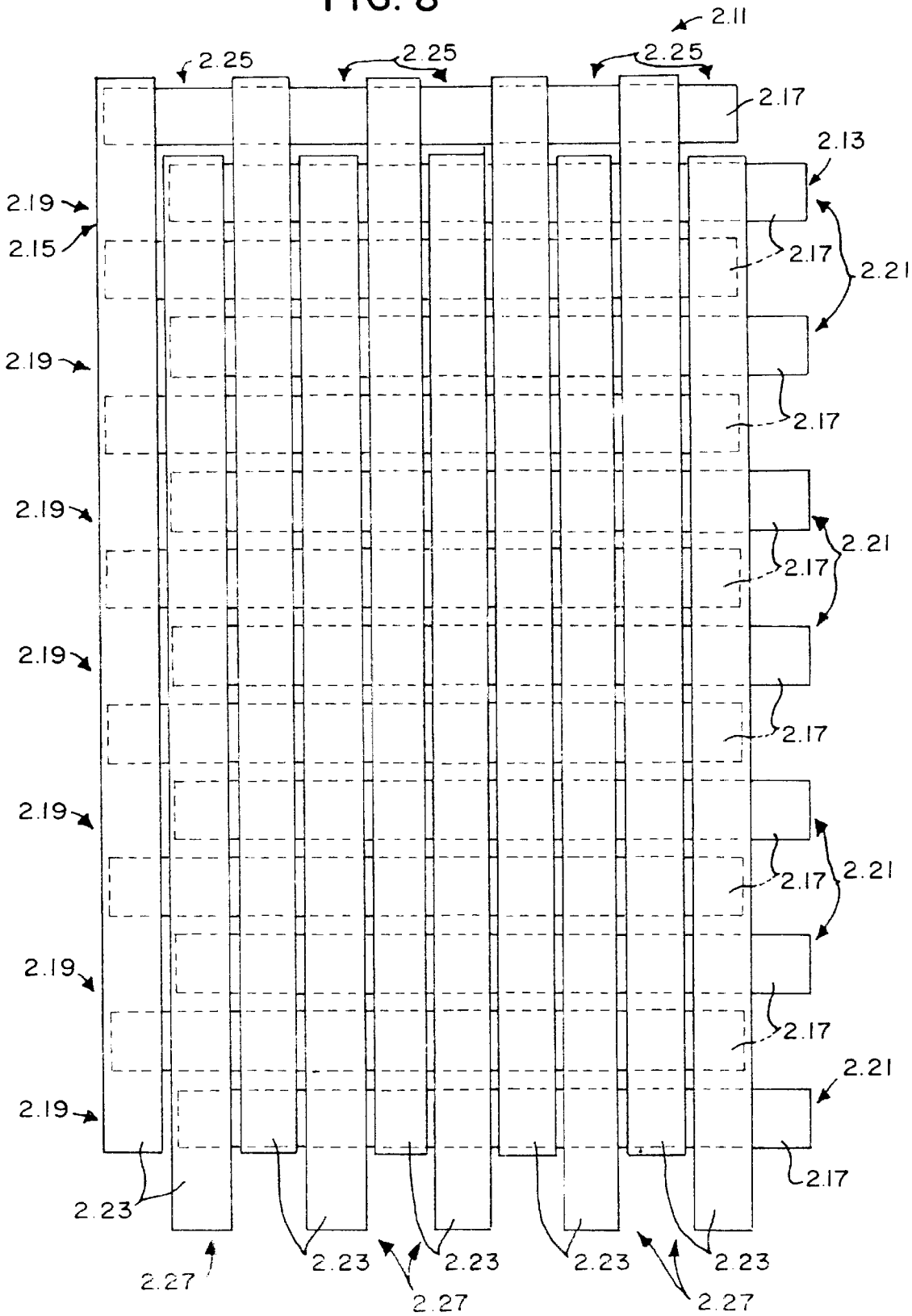
FIG. 8 is a top plan view of the mat of FIG. 7.
Figure 9:
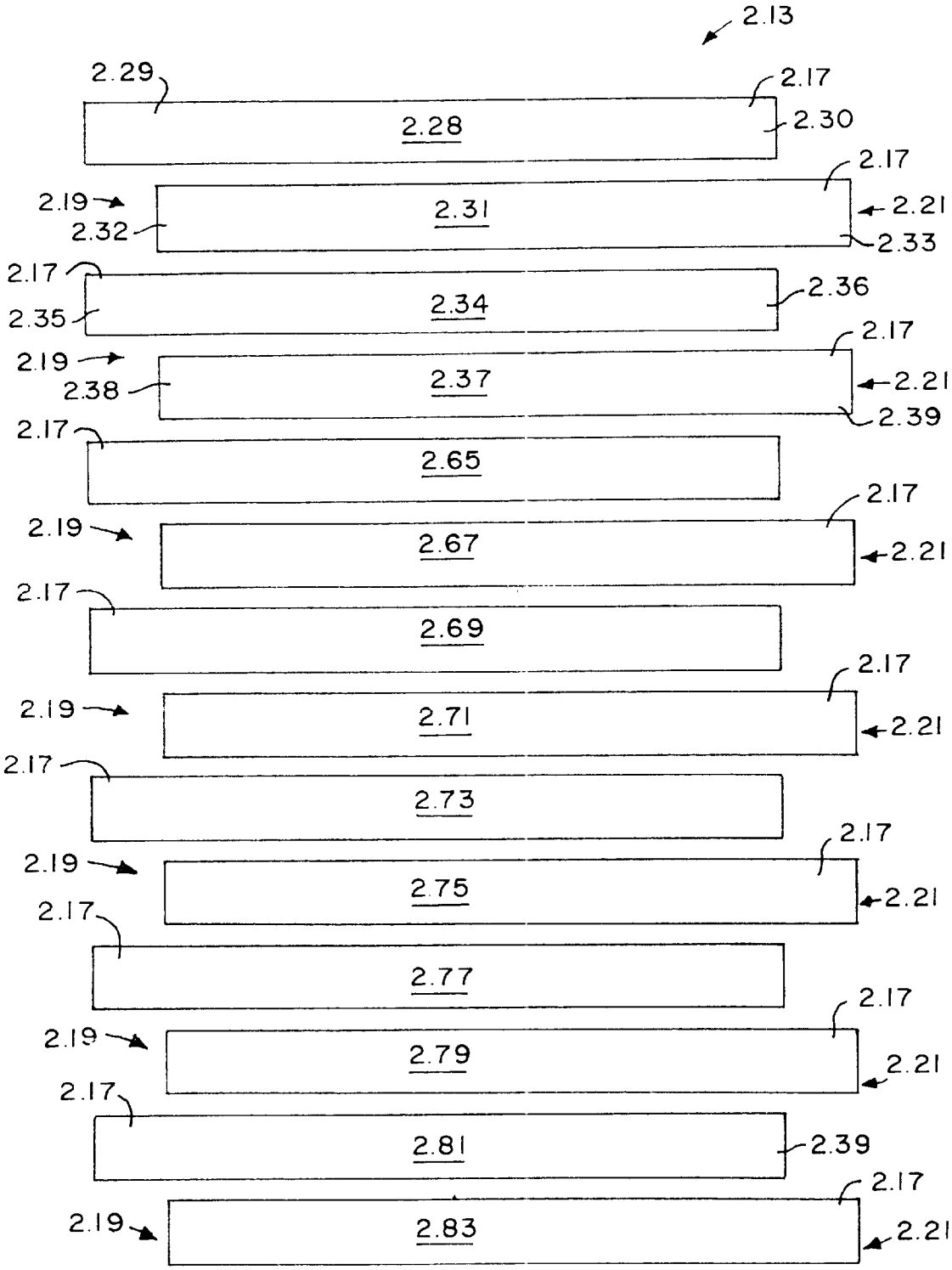
FIG. 9 is a top plan view of the bottom ply or layer of the mat of FIG. 7.
Figure 10:
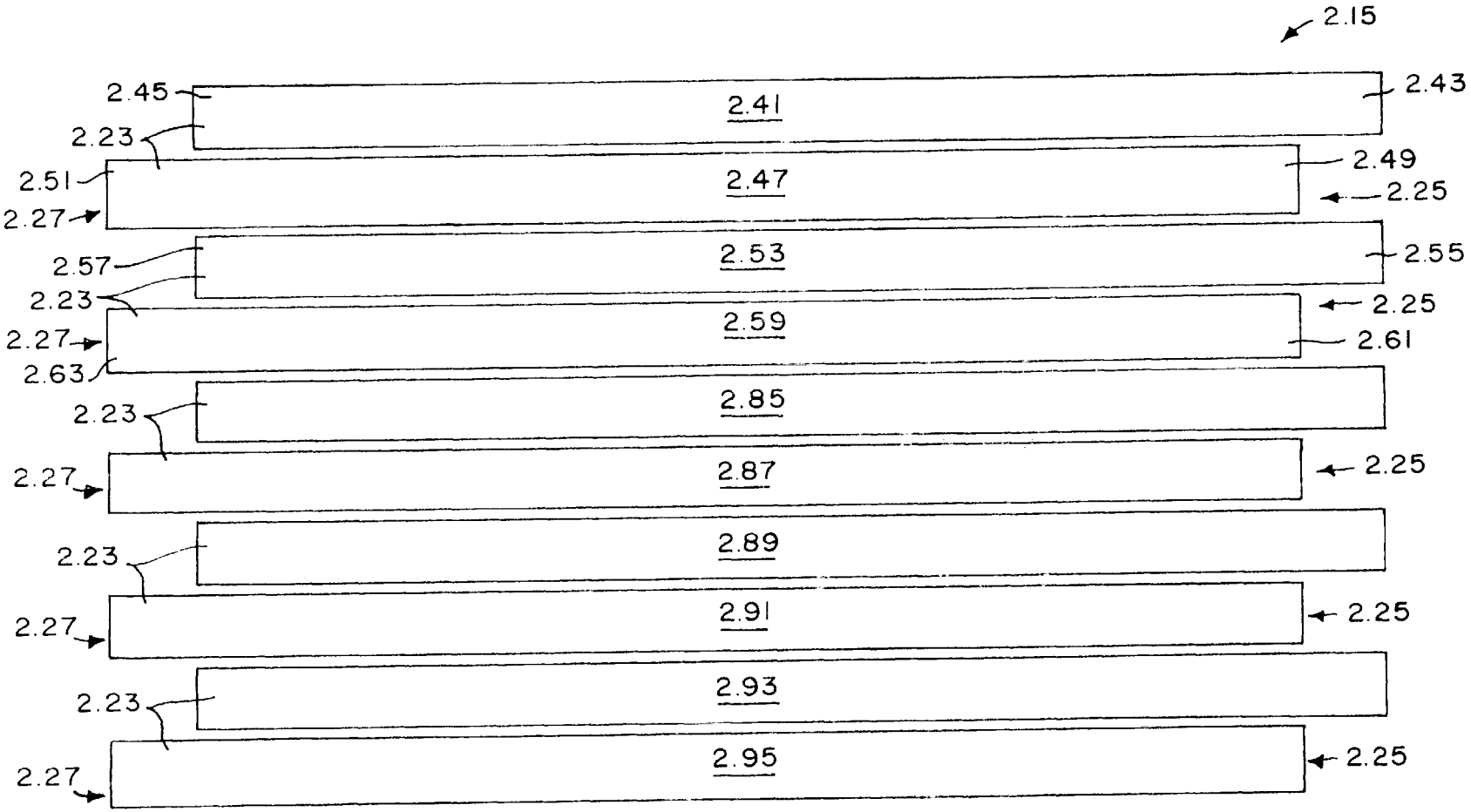
FIG. 10 is a top plan view of the top ply or layer of the mat of FIG. 7.
Figure 11:
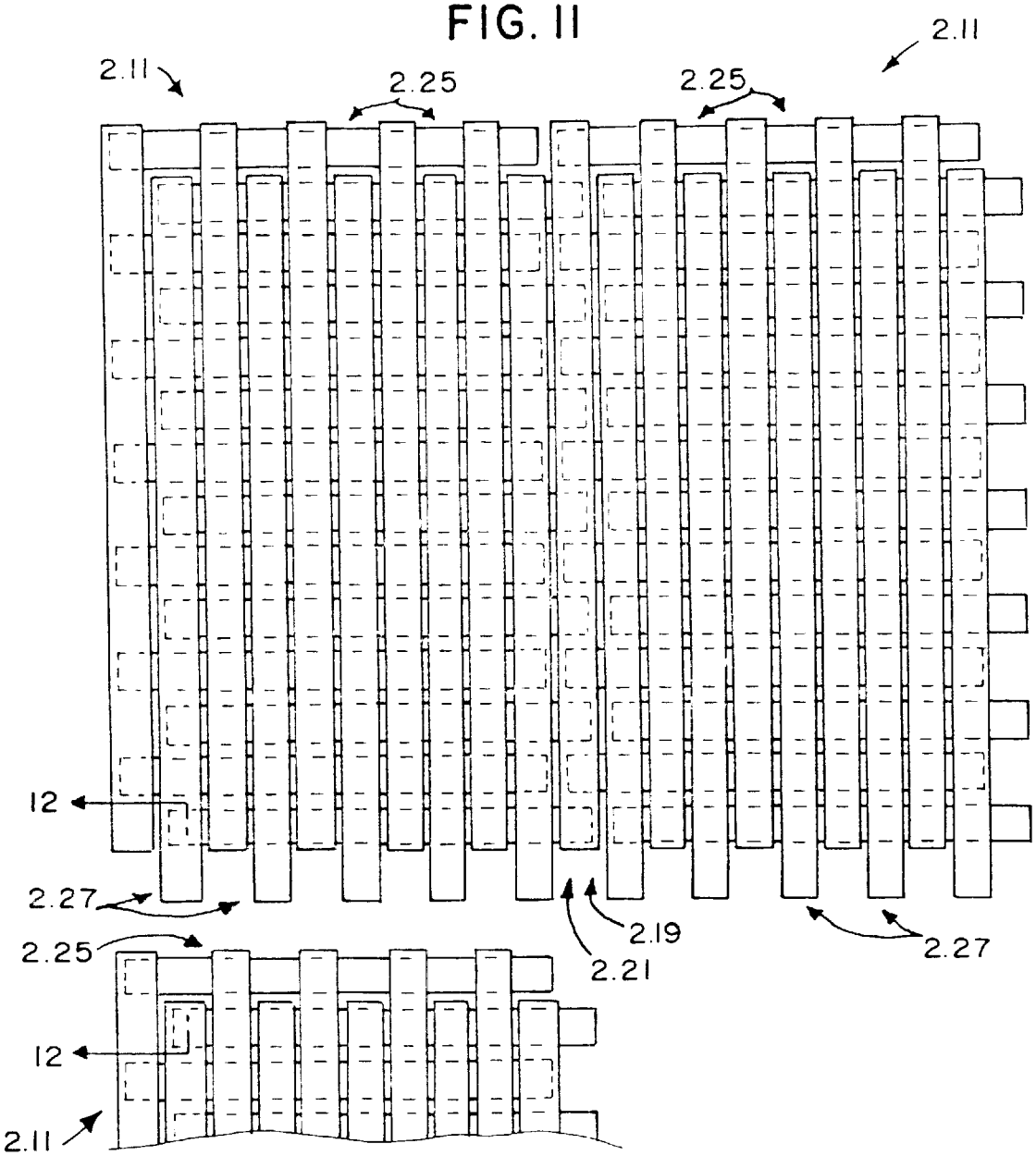
FIG. 11 is a diagrammatic top plan view of several of the mats of FIG. 7 joined and being joined to one another to construct a pad.
Figure 12:
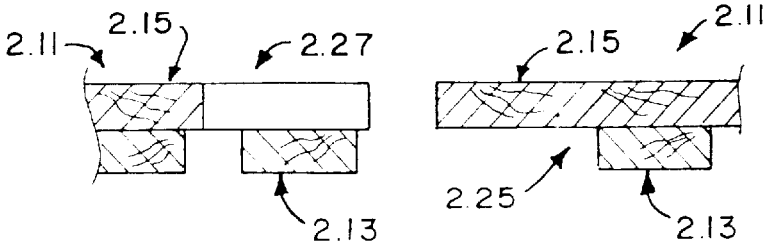
FIG. 12 is a sectional view substantially as taken on line 12—12 of FIG. 11, rotated 90° and on a somewhat enlarged scale.

A second embodiment of the mat of the present invention is shown in FIGS. 7–12 and identified by the numeral 2.11. The mat 2.11 is also designed for use in combination with a plurality of similar mats to provide a temporary support structure used to construct roads and pads to support heavy equipment, but is especially designed for the construction of temporary pads to support heavy construction equipment and trucks typically used in the oil and gas industry and in logging, etc.

The mat 2.11 includes a bottom ply or layer 2.13 and a top ply or layer 2.15.

The bottom ply 2.13 may be constructed from a plurality of boards 2.17 of the same basic size. Thus, for a standard pad, the bottom ply 2.13 may be constructed from a plurality of 2 inches (5.08 centimeters) thick by 8.25 inches (20.95 centimeters) wide by 8 feet (2.4 meters) long lumber. Each board 2.17 is arranged parallel and preferably spaced from one another an equal distance, e.g., 2.125 inches (5.3975 centimeters). The number of boards 2.17 used to construct the bottom ply 2.13 can vary, depending on the length of mat 2.11 desired. Thus, for example, for a mat 2.11 that is 12 feet (3.7 meters) long, the bottom ply 2.13 preferably includes 14 boards 2.17. Similarly, for a mat 2.11 that is 10 feet (3.05 meters) long, the bottom play 2.13 preferably includes 12 boards 2.17; for a mat 2.11 that is 14 feet (4.3 meters) long, the bottom ply 2.13 preferably includes 16 boards 2.17; and for mat 2.11 that is 16 feet (4.9 meters) long, the bottom play 2.13 preferably includes 18 boards 2.17.

While each of the boards 2.17 are preferably the same length, each adjacent board 2.17 is preferably offset or staggered with respect to one another so that, in combination with the top ply 2.15, a slot 2.19 is formed at one end of each board 2.17 and a tab 2.21 is formed at the other end of each board 2.17.

The top ply 2.15 may be constructed from a plurality of boards 2.23 of the same basic size. Thus, for a standard pad, the bottom ply 2.15 may be constructed from a plurality of 2 inches (5.08 centimeters) thick by 8.25 inches (20.95 centimeters) wide lumber. The length of each board 2.23 depends on the desired sized of the mat 2.11. Thus, for a mat 2.11 that is 12 feet (3.7 meters) long, each board 2.23 is preferably 12 feet (3.7 meters) long. Similarly, for a mat 2.11 that is 10 feet (3.05 meters) long, each board 2.23 is preferably 10 feet (3.05 meters); for a mat 2.11 that is 14 feet (4.3 meters) long, each board 2.23 is preferably 14 feet (4.3 meters) long; and for mat 2.11 that is 16 feet (4.9 meters) long, each board 2.23 is preferably 16 feet (4.9 meters) long.

Each board 2.23 is arranged parallel and preferably spaced from one another an equal distance, e.g., 1 inches (2.54 centimeters). While the number of boards 2.23 used to construct the top ply 2.15 can vary, for a bottom ply 2.13 formed of boards 2.17 that are 8 feet (2.4 meters) long, the top ply 2.15 preferably includes ten boards 2.23.

While each of the boards 2.23 are preferably the same length, each adjacent board 2.23 is preferably offset or staggered with respect to one another so that, in combination with the bottom ply 2.13, a slot 2.25 is formed at one end of each board 2.23 and a tab 2.27 is formed at the other end of each board 2.23.

The boards 2.23 of the top ply 2.15 are securely attached to the boards 2.17 of the bottom ply 2.13, using bolts, nails, glue, etc., with the longitudinal axis of each board 2.23 substantially perpendicular to the longitudinal axis of each board 2.17.

To form the slots and tabs 2.19, 2.21, 2.25, 2.27, and with reference to the layout of the mat 2.11 as shown in the drawings, the bottom and top plies 2.13, 2.15 are attached to one another with the left most or first board 2.23 of the top ply 2.15 substantially aligned with the left most end of left most extending boards 2.17 of the bottom ply 2.13, and the uppermost board 2.17 of the bottom ply 2.13 substantially aligned with the upper most end of the upper most extending board 2.23 of the top ply 2.15, so that each slot 2.19 of the bottom ply 2.13 will be overlapped by a portion of the left most board 2.23 of the top ply 2.15 by a distance at least equal to its width, and so that each slot 2.25 of the top ply 2.15 will be overlapped by a portion of the upper most board 2.17 of the bottom ply 2.13.

First Preferred Embodiment

The preferred embodiment of the bottom ply 13 includes a first board section 32 having a first end 33 and a second end 34; a second board section 35 extending parallel to the first board section 32 and having a first end 36 positioned conterminous with the first end 33 of the first board section 32 and a second end 37 positioned intermediate the first and second ends 33, 34 of the first board section 32; a third board section 38 extending parallel to the first board section 32 and having a first end 39 positioned intermediate the first and second ends 33, 34 of the first board section 32 and a second end 40 positioned conterminous with the second end 34 of the first board section 32; and a fourth board section 41 extending parallel to the first board section 32 and having a first end 42 positioned conterminous with the first end 33 of the first board section 32 and a second end 43 positioned conterminous with the second end 34 of the first board section 32. The third board section 43 of the bottom ply 13 is aligned with the second board section 35 thereof, and the second and third board sections 35, 38 are positioned intermediate the first and fourth board sections 32, 41 of the bottom ply 13. The bottom ply 13 has a bottom gap or opening 19 formed between the second end 37 of the second board section 35 and the first end 39 of the third board section 38, and between the first and second board sections 32, 41.

The preferred embodiment of the top ply 15 includes a first board section 45 having a first end 46 and a second end 47, and a second board section 48 having a first end 49 and a second end 51. The first board section 45 of the top ply 15 is attached to and extends perpendicular to the first, second and fourth board sections 32, 35, 41 of the bottom ply 13 adjacent the first ends 33, 36, 42 of the first, second and fourth board sections 32, 35, 41 of the bottom ply 13. The second board section 48 of the top ply 15 is attached to and extends perpendicular to the first, third and fourth board sections 32, 38, 41 of the bottom ply 13 adjacent the second ends 34, 40, 43 of the first, third and fourth board sections 32, 38, 41 of the bottom ply 13. The first and second board sections 45, 48 of the top ply 15 are spaced apart from one another with the space between the first and second board sections 45, 48 generally overlying a bottom gap 19.

The bottom ply 13 preferably includes a fifth board section 55 extending parallel to the first board section 32 thereof and having a first end 57 positioned conterminous with the first end 33 of the first board section 32 and a second end 59 positioned intermediate the first and second ends 33, 34 of the first board section 32; a sixth board section 61 extending parallel to the first board section 32 thereof and having a first end positioned intermediate the first and second ends 33, 34 of the first board section 32 and a second end 65 positioned conterminous with the second end 34 of the first board section 32; and a seventh board section 67 extending parallel to the first board section 32 and having a first end positioned 69 conterminous with the first end 33 of the first board section 32 and a second end 71 positioned conterminous with the second end 34 of the first board section 32 of the bottom ply 13. The sixth board section 61 of the bottom ply 13 is aligned with the fifth board section 55 thereof, and the fifth and sixth board sections 55, 61 are positioned intermediate the fourth and seventh board sections 41, 67 of the bottom ply 13. The bottom ply 13 preferably has another bottom opening or gap 19 formed between the second end 59 of the fifth board section 55 and the first end 63 of the sixth board section 61 thereof, and between the fourth and seventh board sections 41, 67 thereof.

The bottom ply 13 preferably includes a eighth board section 75 extending parallel to the first board section 32 thereof and having a first end 77 positioned conterminous with the first end 33 of the first board section 32 and a second end 79 positioned intermediate the first and second ends 33, 34 of the first board section 32; a ninth board section 81extending parallel to the first board section 32 thereof and having a first end 83 positioned intermediate the first and second ends 33, 34 of the first board section 32 and a second end 85 positioned conterminous with the second end of the first board section 32 of the bottom ply 13; and a tenth board section 87 extending parallel to the first board section 32 thereof and having a first end 89 positioned conterminous with the first end 33 of the first board section 32 and a second end 91 positioned conterminous with the second end 34 of the first board section 32 of the bottom ply 13. The eighth and sixth ninth board sections 75, 81 of the bottom ply 13 are positioned intermediate the seventh and tenth board sections 67, 87 thereof and the ninth board section 81 is aligned with the eighth board section 75 thereof. The bottom ply 13 preferably has another bottom opening or gap 19 formed between the second end 79 of the eighth board section 75 and the first end 83 of the ninth board section 81 thereof, and between the seventh and tenth board sections 67, 87 thereof.

The bottom ply 13 preferably includes an eleventh board section 95 extending parallel to the first board section 32 thereof and having a first end 97 positioned conterminous with the first end 33 of the first board section 32 and a second end 99 positioned intermediate the first and second ends 33, 34 of the first board section 32 thereof; a twelfth board section 101 extending parallel to the first board section 32 of the bottom ply 13 and having a first end 103 positioned intermediate the first and second ends 33, 34 of the first board section 32 and a second end 105 positioned conterminous with the second end 34 of the first board section 32 of the bottom ply 13; and a thirteenth board section 107 extending parallel to the first board section 32 thereof and having a first end 109 positioned conterminous with the first end 33 of the first board section 13 and a second end 111 positioned conterminous with the second end 34 of the first board section 32 of the bottom ply 13. The eleventh and twelfth board sections 95, 101 of the bottom ply 12 are positioned intermediate the tenth and thirteenth board sections 87, 107 thereof, and the twelfth board section 101 is aligned with the eleventh board section 95 of the bottom ply 13. The bottom ply 13 has another bottom opening or gap 19 formed between the second end 99 of the eleventh board section 95 and the first end 103 of the twelfth board section 101 of the bottom ply 13.

The top ply 15 preferably includes a third board section 115 attached to and extending perpendicular to the first board section 32 of the bottom ply 13 between the first and second board sections 45, 48 of the top ply 15, and having a first end 117 and a second end 119. The top ply 15 preferably includes a fourth board section 121 attached to and extending perpendicular to the seventh board section 67 of the bottom ply between the first and second board sections 45, 48 of the top ply 15, and having a first end 123 and a second end 125. The top ply 15 preferably includes a fifth board section 127 attached to and extending perpendicular to the thirteenth board section 107 of the bottom ply 13 between the first and second board sections 45, 48 of the top ply 13, and having a first end 129 and a second end 131. The space between the first and second board sections 45, 48 of the top ply 13 is preferably divided into a first top space or gap 133 between the first and second board sections 45, 48 and between the third and fourth board sections 115, 121 for being aligned over one or more bottom gaps 19 with the intermediate portion of the fourth board section 41 of the bottom ply 13 extending thereacross; and a second top space or gap 135 between the first and second board sections 45, 48 and between the fourth and fifth board sections 121, 127 for being aligned over one or more bottom gaps 19 with the intermediate portion of the tenth board section 87 of the bottom ply 13 extending thereacross.

The mats 11 may be constructed in various manners and out of various materials, and in various sizes as will now be apparent to those skilled in the art. As hereinabove indicated, each of the board sections of the bottom and top plies 13, 15 preferably include a plurality of parallel boards. Each individual board of each board section of the bottom ply 13 are preferably coextensive with each other individual board of that board section (i.e., each individual board of each board section is of equal length and the opposite ends are aligned with each other individual board of that board section). As indicated above, each runner 21, 23 (i.e., each first and second board section 45, 48) of the top ply 15 may be constructed from a plurality of individual parallel boards with the opposite ends of the middle individual parallel boards being offset from the opposite ends of the outer individual parallel boards an amount to form the interlocking slots and tabs 27, 29. The bottom and top plies 13, 15 can be built out of standard hardwood lumber using a jig or the like to insure precise placement and squareness, with the individual boards of the bottom and top plies 13, 15 fastened together by means of bolts, nails, glue, etc. The word "board" is used herein to define any generally long, rectangular, thin piece of lumber or other substantially rigid material, preferably having a shear stress substantially equal to or greater than that of typical hardwood lumber, etc. The phrase "board section" is used herein to define a board that is composed either from a single, unitary member or a plurality of individual members, or boards, joined together.

Second Preferred Embodiment

A second embodiment of the mat of the present invention is shown in FIGS. 7–12 and identified by the numeral 2.11. The mat 2.11 is also designed for use in combination with a plurality of similar mats to provide a temporary support structure used to construct roads and pads to support heavy equipment. The mat 2.11 is especially designed for the construction of temporary pad to support heavy construction equipment typically used in the oil and gas industry and in logging, etc.

The mat 2.11 includes a bottom ply or layer 2.13 and a top ply or layer 2.15.

The bottom ply 2.13 includes a first bottom ply board 2.28 having a first end 2.29 and a second end 2.30, a second bottom ply board 2.31 having a first end 2.32 and a second end 2.33 positioned adjacent the first bottom ply board 2.28, a third bottom ply board 2.34 positioned adjacent the second bottom ply boards 2.31 and having a first end 2.35 and a second end 2.36, and a fourth bottom ply board 2.37 positioned adjacent the third bottom ply boards 2.34 and having a first end 2.38 and a second end 2.39. Each of the bottom ply boards 2.28, 2.31, 2.34, 2.37 are of equal length and are arranged parallel to one another and offset lengthwise from each adjacent bottom ply board 2.28, 2.31, 2.34, 2.37.

The top ply 2.15 includes a first top ply board 2.41 having a first end 2.43 and a second end 2.45, a second top ply board 2.47 having a first end 2.49 and a second end 2.51 and positioned adjacent the first top ply board 2.41, a third top ply board 2.59 positioned adjacent the second top ply board 2.47 and having a first end 2.55 and a second end 2.57, and a fourth top ply board 2.59 positioned adjacent the third top ply board 2.59 and having a first end 2.61 and a second end 2.63. Each the top ply boards 2.41, 2.47, 2.53, 2.59 are of equal length and are arranged parallel to one another and offset lengthwise from each adjacent top ply board 2.41, 2.47, 2.53, 2.59.

The bottom and top plies 2.13, 2.15 are attached to one another with each of the top ply boards 2.41, 2.47, 2.53, 2.59 extending perpendicular to each of the bottom ply boards 2.28, 2.31, 2.34, 2.37, with the first end 2.43 of the first top ply board 2.41 positioned over the first end 2.29 of the first bottom ply board 2.28, with the first end 2.49 of the second top ply board 2.47 positioned over the first end 2.32 of the second bottom ply board 2.31, with the first end 2.55 of the third top ply board 2.53 positioned over the first bottom ply board 2.28, with the first end 2.61 of the fourth top ply board 2.59 positioned over the second bottom ply board 2.31, with the first end 2.35 of the third bottom ply board 2.34 positioned over the first top ply board 2.41, and with the first end 2.38 of the fourth bottom ply board 2.37 positioned over the second top ply board 2.47, thus forming the tabs and slots 2.19, 2.25 on opposite ends of each top ply board and on the opposite ends of each bottom ply board.

While the number and size of boards 2.17, 2.23 can vary depending on the size of the mat 2.11 desired, as hereinabove disclosed, for a mat 2.11 that is 12 feet (3.7 meters) long, the bottom ply 2.13 preferably includes a fifth bottom ply board 2.65, a sixth bottom ply board 2.67, a seventh bottom ply board 2.69, an eight bottom ply board 2.71, a ninth bottom ply board 2.73, a tenth bottom ply board 2.75, an eleventh bottom ply board 2.77, a twelfth bottom ply board 2.79, a thirteenth bottom ply board 2.81, and a fourteenth bottom ply board 2.83; and the top ply 2.15 preferably includes a fifth top ply board 2.85, a sixth top ply board 2.87, a seventh top ply board 2.89, an eight top ply board 2.91, a ninth top ply board 2.93, and a tenth top ply board 2.95, with the ends of the additional top and bottom ply boards arranged in a manner like that disclosed hereinabove relative to the first four top and bottom ply boards to form the tabs and slots 2.19, 2.25 on opposite ends of each additional top ply board and on the opposite ends of each additional bottom ply board.

Left and right side versions of the mat 2.11 can be constructed by merely reversing the layout of the boards 2.23 of the top ply 2.15 on the boards 2.17 of the bottom ply 2.13. Thus, the mat 2.11 shown FIGS. 7 and 8 can be considered a right side mat. By merely moving the boards 2.23 of the top ply 2.15 to the right one board width so that the tenth top ply board 2.95 is positioned over the second ends of the second, fourth, sixth, eight, tenth, twelfth and fourteenth bottom ply boards 2.47, 2.59, 2.67, 2.71, 2.75, 2.79, 2.83, etc., the mat 2.11 can be considered a left side mat.

The mats 2.11 may be constructed in various manners and out of various materials, and in various sizes as will now be apparent to those skilled in the art. As hereinabove indicated, each of the board sections of the bottom and top plies 2.13, 2.15 preferably include a plurality of parallel boards. Each individual board of the bottom and top plies 2.13, 2.15 are preferably parallel to and the same length as all other individual boards of that ply 2.13, 2.15. However, each adjacent board of each ply 2.13, 2.15 is offset from one another lengthwise to form the coacting, interlocking tabs 2.21 and slots 2.25. The bottom and top plies 2.13, 2.15 can be built out of standard hardwood lumber using a jig or the like to insure precise placement and squareness, with the individual boards of the bottom and top plies 2.13, 2.15 fastened together by means of bolts, nails, glue, etc. The word "board" is used herein to define any generally long, rectangular, thin piece of wood or other substantially rigid material, composed either from a single, unitary member or a plurality of individual members, or boards, joined together, and preferably having a shear stress substantially equal to or greater than that of typical hardwood lumber, etc.

Description of Method of Use

A temporary structure such as a road or pad is constructed using a plurality of the mats of the present invention (either the mats 11 or the mats 2.11) by lifting a first mat with a forklift, crane, grapple, or other suitable equipment, and then moving that first mat into place, putting a tab end of the first mat at the starting point and putting a slotted end of the first mat in the direction of the end of the road or pad. A second mat is then lifted with the forklift, crane, grapple, or other suitable equipment, and then moved into place with the tabs of a tab end of the second mat extending into the slots of a slotted end of the first mat, with the top layer of boards being parallel or in line on both mats. This step is repeated until rows of mats of sufficient length and width are connected to build the desired road, pad, etc. If a two ply structure is not sufficient to carry the required loads on the particular ground, additional mats can be laid over the first layer of mats to reach the required mat strength (e.g., 4 ply, 6 ply, etc.). If a three ply structure is desired, a layer of loose lumber can be laid for the bottom layer of the structure and the mats can be laid over the loose lumber.

As thus constructed and used, the matting system of the present invention eliminates putting down layers of matting material for the sole use of connecting the mats together, and reduces cost through less trucking and handling of the mats by laborers and equipment. The upper and lower layers of each mat are perpendicular to one another and all boards on each layer are uniformly spaced to minimize cracks and maximize strength of the mat. The slots and tabs on each mat are also uniformly spaced and of sufficient length so that every board on the top and bottom layers of the mat is overlapped by at least the length of the board's width. When a plurality of the mats are locked together using the slots' and tabs, a very stable working area is provided because the slots and tabs of the surrounding mats hold each mat in place.

Although the present invention has been described and illustrated with respect to preferred embodiments and preferred uses therefor, it is not to be so limited since modifications and changes can be made therein which are within the full intended scope of the invention.

What is claimed is:

1. A mat for a temporary support structures used to construct roads and pads to support heavy equipment, said mat comprising:

(a) a bottom ply;

said bottom ply including a first board section having a first end and a second end;

said bottom ply including a second board section extending parallel to said first board section of said bottom ply; said second board section of said bottom ply having a first end positioned conterminous with said first end of said first board section of said bottom ply and a second end positioned intermediate said first and second ends of said first board section of said bottom ply;

said bottom ply including a third board section extending parallel to said first board section of said bottom ply; said third board section of said bottom ply having a first end positioned intermediate said first and second ends of said first board section of said bottom ply and a second end positioned conterminous with said second end of said first board section of said bottom ply; said third board section of said bottom ply being aligned with said second board section of said bottom ply;

said bottom ply having a bottom gap formed between said second end of said second board section of said bottom ply and said first end of said third board section of said bottom ply;

said bottom ply including a fourth board section extending parallel to said first board section of said bottom ply; said fourth board section of said bottom ply having a first end positioned conterminous with said first end of said first board section of said bottom ply and a second end positioned conterminous with said second end of said first board section of said bottom ply;

said second and third board sections of said bottom ply being positioned intermediate said first and fourth board sections of said bottom ply; and (b) a top ply;

said top ply including a first board section having a first end and a second end;

said top ply including a second board section having a first end and a second end;

said first board section of said top ply being attached to and extending perpendicular to said first, second and fourth board sections of said bottom ply adjacent said first ends of said first, second and fourth board sections of said bottom ply;

said second board section of said top ply being attached to and extending perpendicular to said first, third and fourth board sections of said bottom ply adjacent said second ends of said first, third and fourth board sections of said bottom ply;

said top ply having a top gap formed between said first and second board sections of said top ply;

said top gap overlying said bottom gap.

2. The mat of claim 1 in which:

said bottom ply includes a fifth board section extending parallel to said first board section of said bottom ply; said fifth board section of said bottom ply having a first end positioned conterminous with said first end of said first board section of said bottom ply and a second end positioned intermediate said first and second ends of said first board section of said bottom ply;

said bottom ply including a sixth board section extending parallel to said first board section of said bottom ply; said sixth board section of said bottom ply having a first end positioned intermediate said first and second ends of said first board section of said bottom ply and a second end positioned conterminous with said second end of said first board section of said bottom ply;

said sixth board section of said bottom ply being aligned with said fifth board section of said bottom ply;

said bottom ply having a bottom gap formed between said second end of said fifth board section of said bottom ply and said first end of said sixth board section of said bottom ply;

said bottom ply including a seventh board section extending parallel to said first board section of said bottom ply; said seventh board section of said bottom ply having a first end positioned conterminous with said first end of said first board section of said bottom ply and a second end positioned conterminous with said second end of said first board section of said bottom ply;

said fifth and sixth board sections of said bottom ply being positioned intermediate said fourth and seventh board sections of said bottom ply.

3. The mat of claim 2 in which:

said bottom ply includes a eighth board section extending parallel to said first board section of said bottom ply; said eighth board section of said bottom ply having a first end positioned conterminous with said first end of said first board section of said bottom ply and a second end positioned intermediate said first and second ends of said first board section of said bottom ply;

said bottom ply including a ninth board section extending parallel to said first board section of said bottom ply; said ninth board section of said bottom ply having a first end positioned intermediate said first and second ends of said first board section of said bottom ply and a second end positioned conterminous with said second end of said first board section of said bottom ply;

said ninth board section of said bottom ply being aligned with said eighth board section of said bottom ply;

said bottom ply having a bottom gap formed between said second end of said eighth board section of said bottom ply and said first end of said ninth board section of said bottom ply;

said bottom ply including a tenth board section extending parallel to said first board section of said bottom ply; said tenth board section of said bottom ply having a first end positioned conterminous with said first end of said first board section of said bottom ply and a second end positioned conterminous with said second end of said first board section of said bottom ply;

said eighth and sixth ninth board sections of said bottom ply being positioned intermediate said seventh and tenth board sections of said bottom ply.

4. The mat of claim 3 in which:

said bottom ply includes an eleventh board section extending parallel to said first board section of said bottom ply; said eleventh board section of said bottom ply having a first end positioned conterminous with said first end of said first board section of said bottom ply and a second end positioned intermediate said first and second ends of said first board section of said bottom ply;

said bottom ply including a twelfth board section extending parallel to said first board section of said bottom ply; said twelfth board section of said bottom ply having a first end positioned intermediate said first and second ends of said first board section of said bottom ply and a second end positioned conterminous with said second end of said first board section of said bottom ply;

said twelfth board section of said bottom ply being aligned with said eleventh board section of said bottom ply;

said bottom ply having a bottom gap formed between said second end of said eleventh board section of said bottom ply and said first end of said twelfth board section of said bottom ply;

said bottom ply including a thirteenth board section extending parallel to said first board section of said bottom ply; said thirteenth board section of said bottom ply having a first end positioned conterminous with said first end of said first board section of said bottom ply and a second end positioned conterminous with said second end of said first board section of said bottom ply;

said eleventh and twelfth board sections of said bottom ply being positioned intermediate said tenth and thirteenth board sections of said bottom ply.

5. The mat of claim 4 in which said top ply includes a third board section attached to and extending perpendicular to said first board section of said bottom ply between said first and second board sections of said top ply.

6. The mat of claim 5 in which said top ply includes a fourth board section attached to and extending perpendicular to said seventh board section of said bottom ply between said first and second board sections of said top ply.

7. The mat of claim 6 in which said top ply includes a fifth board section attached to and extending perpendicular to said thirteenth board section of said bottom ply between said first and second board sections of said top ply.

8. The mat of claim 1 in which said first board section of said bottom ply includes a plurality of coextensive, parallel boards; in which said fourth board section of said bottom ply includes a plurality of coextensive, parallel boards; in which said first board section of said top ply includes plurality of parallel boards; and in which said second board section of said top ply includes plurality of parallel boards.

9. The mat of claim 4 in which said seventh board section of said bottom ply includes a plurality of coextensive, parallel boards; in which said tenth board section of said bottom ply includes a plurality of coextensive, parallel boards; and in which said thirteenth board section of said bottom ply includes a plurality of coextensive, parallel boards.

10. The mat of claim 7 in which said third board section of said top ply includes a plurality of coextensive, parallel boards; in which said fourth board section of said top ply includes plurality of coextensive, parallel boards; and in which said fifth board section of said top ply includes plurality of coextensive, parallel boards.

11. A mat for a temporary support structures used to construct roads and pads to support heavy equipment, said mat consisting of a bottom ply and a top ply:

(a) said bottom ply including a first bottom ply board, a second bottom ply board positioned adjacent said first bottom ply board, a third bottom ply board positioned adjacent said second bottom ply board, and a fourth bottom ply board positioned adjacent said third bottom ply board; each of said bottom ply boards being spaced from each adjacent bottom ply board, being of equal length, being of equal width, being arranged parallel to one another, and being offset lengthwise from each adjacent bottom ply board with each end of each of said bottom ply boards staggered lengthwise from each end of each adjacent one of said bottom ply boards; and (b) said top ply including a first top ply board, a second top ply board positioned adjacent said first top ply board, a third top ply board positioned adjacent said second top ply board, and a fourth top ply board positioned adjacent said third top ply board; each of said top ply boards being spaced from each adjacent top ply board, being of equal length, being of equal width, being arranged parallel to one another, and being offset lengthwise from each adjacent top ply board with each end of each of said top ply boards staggered lengthwise from each end of each adjacent one of said top ply boards;

said bottom and top plies being attached to one another with each of said top ply boards extending perpendicular to each of said bottom ply boards;

said first end of said first top ply board being positioned over said first end of said first bottom ply board;

said first end of said second top ply board being positioned over said first end of said second bottom ply board;

said first end of said third top ply board being positioned over said first bottom ply board a distance from said second end of said first bottom ply board at least equal to the width of said third top ply board;

said first end of said fourth top ply board being positioned over said second bottom ply board a distance from said second end of said second bottom ply board at least equal to the width of said fourth top ply board.

* * * * *